US005713239A

United States Patent [19]

Kirschner

[11] Patent Number: 5,713,239

[45] Date of Patent: Feb. 3, 1998

[54] PROJECTILE TESTING SYSTEM AND METHOD

[75] Inventor: Ivan N. Kirschner, Portsmouth, R.I.

[73] Assignee: The United States of America as represented by the Secretary of the Navy, Washington, D.C.

[21] Appl. No.: 708,105

[22] Filed: Aug. 28, 1996

[51] Int. Cl.[6] ..... F41A 31/00; F42B 35/00

[52] U.S. Cl. ..... 73/167

[58] Field of Search ..... 73/167; 273/408; 434/11, 16, 19, 23, 25

[56] References Cited

U.S. PATENT DOCUMENTS

| | | | |
|---|---|---|---|
| 197,398 | 11/1877 | O'Neil | 73/167 |
| 523,510 | 7/1894 | Brunswig | 73/167 |
| 3,656,056 | 4/1972 | Daizell, Jr. | 73/167 X |
| 3,792,354 | 2/1974 | Slaght et al. | 73/167 X |
| 4,845,690 | 7/1989 | Oehler | 73/167 X |

FOREIGN PATENT DOCUMENTS

| | | | |
|---|---|---|---|
| 661928 | 2/1961 | Italy | 73/167 |

*Primary Examiner*—William A. Cuchlinski, Jr.
*Assistant Examiner*—Willie Morris Worth
*Attorney, Agent, or Firm*—Michael J. McGowan; James M. Kasischke; Prithvi C. Lall

[57] ABSTRACT

A projectile testing system and method is used to assess the projectile flight and test the accuracy of a projectile launcher and projectile in both controlled and uncontrolled underwater environments. The projectile testing system includes a penetrable member that is positioned substantially orthogonal to an expected flight path of the projectile. The penetrable member intercepts the projectile, forming a penetration in the penetrable member. The location of the penetration is used to determine the actual flight path of the projectile. The penetrable member further includes side support members that help keep the penetrable member taut. In an underwater environment, flotation members and anchor members are coupled to the penetrable member, to hold or support the penetrable member taut. The projectile testing system can also include multiple penetrable members positioned consecutively to provide a more accurate assessment of the actual flight path of a projectile.

18 Claims, 2 Drawing Sheets

PROJECTILE TESTING SYSTEM AND METHOD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field Of The Invention

This invention relates to underwater projectile launching and testing systems and in particular, to a testing system for assessing the flight path of an underwater projectile fired from a submerged launcher.

(2) Description Of The Prior Art

The development and use of submerged projectiles and projectile launchers requires an assessment of the projectile flight and accuracy. The actual path of a projectile can deviate from a desired ideal path. The actual path of a projectile can be difficult to predict, particularly in an uncontrolled underwater environment. At longer ranges, especially, the projectile might miss the desired target by a great distance.

Assessment of the underwater flight of projectiles is typically performed at a test range equipped with a number of acoustic sensors located throughout the range. The sensors track the projectiles as they move throughout the range. However, as the size of the projectile decreases and the speed of the projectile increases, accurately tracking the projectile and/or predicting the projectile flight becomes difficult. During early development of both the projectiles and tracking systems, independent assessment of their performance is required.

The traditional methods and devices for tracking large, slow-moving undersea vehicles (such as torpedoes) cannot yet accurately track the path of smaller projectiles, such as underwater bullets. In a controlled setting, such as a laboratory, the projectiles can be fired at a close range in order to assess the flight of the projectile. However, testing and predicting projectile flight for longer ranges becomes difficult.

Prior art devices exist for testing the accuracy and shot velocity of firearms, such as U.S. Pat. Nos. 3,285,066 to Lage, 3,893,336 to Tucker, and 3,899,175 to Loe. Because they are designed for use with conventional bullets, such devices do not provide for an accurate assessment of a projectile path, particularly at longer ranges. These prior art devices also are not capable of being used in an underwater environment to accurately assess the flight path of underwater projectiles at long ranges.

SUMMARY OF THE INVENTION

Accordingly, one object of the present invention is to provide a projectile testing system that accurately records the path of an underwater projectile over significant distances especially on an open range.

Another object of the present invention is to accurately assess or determine the path of smaller projectiles.

A further object of the present invention is to allow testing in an uncontrolled underwater environment at longer ranges, such as an open sea environment.

The present invention features a projectile testing system for recording and assessing a path of at least one projectile launched from at least one projectile launcher. The projectile testing system includes at least one penetrable member positioned in the possible path of the projectile for intercepting the projectile and forming a penetration in the penetrable member. The path of the projectile is determined based upon at least one of the location, size or shape of the penetration. The projectile testing system further includes a penetrable member support, for supporting the penetrable member in the path of the projectile. The penetrable member is positioned at a predetermined distance and orientation with respect to the projectile launcher. The predetermined distance and orientation of the penetrable member with respect to the projectile launcher is also used to assess or determine the path taken by the projectile.

According to the preferred embodiment, the projectile testing system is used in an underwater environment, and the penetrable member is positioned in the underwater environment. According to different embodiments, the projectile launcher is either positioned in the underwater environment or above a surface of the underwater environment. Another embodiment of the projectile testing system includes a plurality of penetrable members positioned consecutively in the path of the projectile.

The preferred embodiment of the penetrable member includes a screen held taut by the penetrable member support. In one example, the screen is made from a mesh that allows the projectile to penetrate without substantially slowing or altering the path of the projectile. The penetrable member or screen is substantially flat when held taut and lies in a plane substantially orthogonal to the expected path of the projectile.

The preferred embodiment of the penetrable member support includes at least first and second side support members positioned respectively along first and second sides or edges of the penetrable member, for ensuring that the penetrable member is held taut. According to an alternative embodiment, the penetrable member can include a side support member or members positioned around all edges of the penetrable member, for supporting the penetrable member and holding the penetrable member taut.

One embodiment of the penetrable member support used in an underwater environment includes at least one flotation member coupled to a first edge of the penetrable member or side support member, for supporting the penetrable member in a first direction, e.g., by floating on the surface of the water. The penetrable member further includes at least one anchor member coupled to a second edge of the penetrable member or second side support member, for supporting the penetrable member in a second direction, e.g., by anchoring to the floor of the underwater environment. One or more support lines extending from the first and second edges or side support members preferably couple the penetrable member to the flotation member and the anchor member respectfully.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
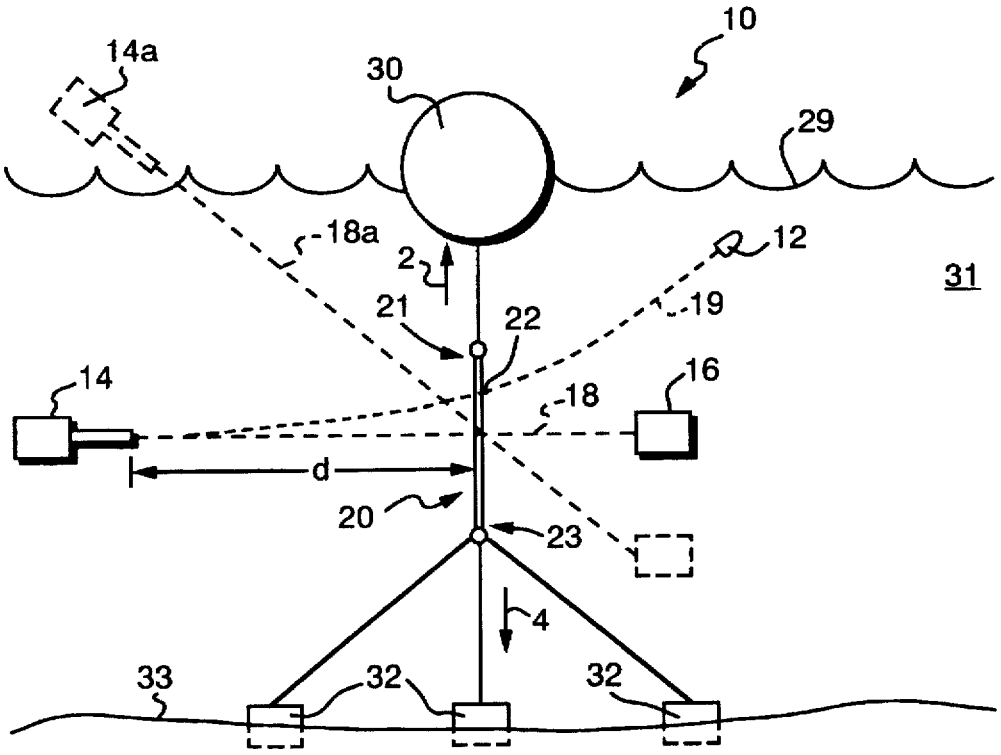
FIG. 1 is a schematic side view of the projectile testing system having a penetrable member according to the present invention.

A projectile testing system 10, FIG. 1, according to the present invention, is used to test projectiles 12 and projectile launchers 14, by providing for the recording and assessment of the projectile flight path. Typically, a projectile 12 is launched or fired at a target 16 and must follow an ideal flight path 18 in order to hit the target 16. The actual path 19 taken by the projectile 12 will often stray from the ideal flight path 18, for example, because of environmental factors and hydrodynamic forces on the projectile 12.

The projectile testing system 10 includes a penetrable member 20 positioned substantially orthogonal to the possible flight paths of the projectile 12. The penetrable member 20 intercepts and is penetrated by the projectile 12 forming a penetration 22 that indicates the actual path 19 taken by the projectile 12 fired from the projectile launcher 14. The penetrable member 20 is positioned and supported at a predetermined distance d from the projectile launcher 14. The actual flight path 19 taken by the projectile 12 is assessed or determined based upon the distance d and orientation of the penetrable member 20 with respect to the launcher 14 as well as the size, shape and position of the penetration 22 formed in the penetrable member 20 by the projectile 12. The shape and size of the penetration 22 provides ballistics data used to determine the pitch and yaw orientation of the projectile 12 and the evolution of the orientation during flight. The ballistics data can be correlated with other flight path data using analytical models.

The projectile testing system 10, according to the present invention, can be used in many types of environments. Preferably, the projectile testing system 10 is used in an underwater environment, for example, in either a controlled short range underwater environment or an uncontrolled long range environment, such as an open sea environment. The uncontrolled underwater environment testing allows the projectiles to be tested in the varying conditions that will exist during the actual use of the projectiles and might impact projectile flight.

In one embodiment, the projectile launcher 14 is actually located in the underwater environment. In another embodiment, a projectile launcher **14*a* is positioned above the surface 29 of the underwater environment and the projectile 12 is fired into the water 31. The ideal flight path for this arrangement is shown by path 18*a*. The present invention also contemplates using the projectile testing system 10** to test the launching of projectiles from a submerged launcher into the air.

When used in an underwater environment, the projectile testing system 10 typically includes one or more flotation members 30, such as a buoy floating on the surface 29 of the water 31, coupled to a first side or edge 21 of the penetrable member 20 for supporting or pulling the penetrable member 20 in a first direction shown generally by arrow 2. The projectile testing system 10 further includes one or more anchor members 32, such as moorings positioned on the floor 33 of the underwater environment, coupled to a second side or edge 23 of the penetrable member 20 for supporting or pulling the penetrable member 20 in a second direction indicated generally by arrow 4.

Figure 2:
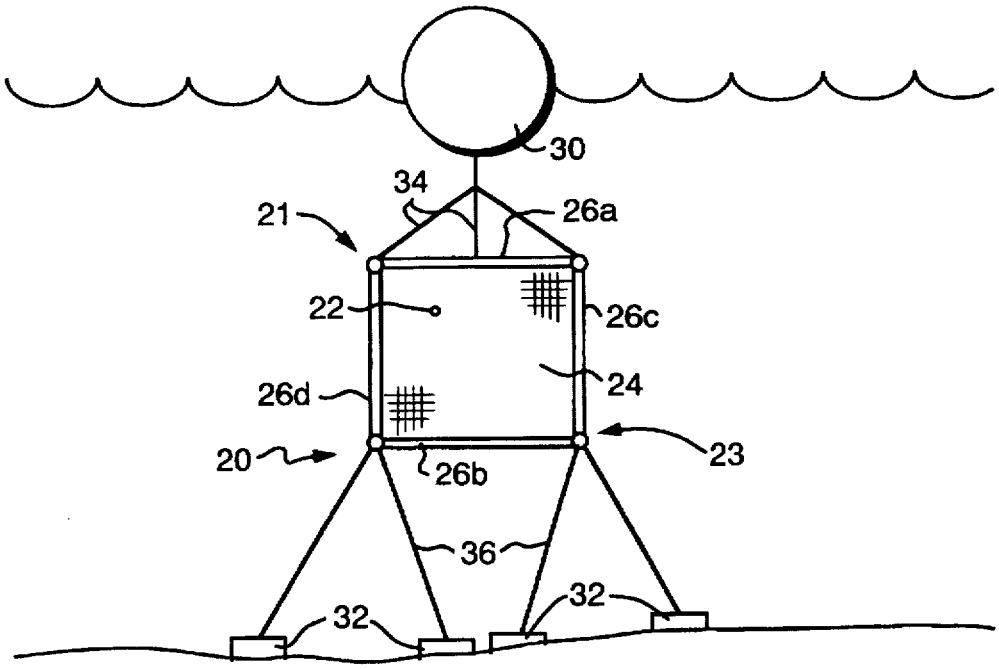
FIG. 2 is a schematic front view of the projectile testing system according to the present invention.

According to the preferred embodiment, the penetrable member 20, FIG. 2, includes a witness screen 24 made, for example, from a light mesh made of corrosion resistant window screen material, mylar, or other flexible material, or from sheet metal, such as steel, or foil, which allows a projectile to easily pass through and penetrate the screen 24 without stopping, considerably slowing, or substantially altering the flight path of the projectile. The witness screen 24 is preferably a mesh of a size substantially greater than the maximum anticipated deviation of the projectile from the intended flight path at the location of the screen 24, and supported by at least first and second side support members **26*a*, 26*b* fixed to the screen at the first and second edges 21, 23 respectively. The side support members 26*a*, 26*b* are preferably rigid and made of suitable structural material such as prefabricated steel or polyvinyl chloride pipe to ensure that the screen is maintained taut and fully extended. The screen 24 is held taut to ensure that the penetration 22 produced by the projectile substantially represents the projected profile of the projectile during the short period of penetration and the screen 24 is not substantially deformed by the force of the projectile. Such a penetration allows for a more accurate measurement because the size, shape and position of the penetration 22** can be more accurately determined.

The flotation member 30 is coupled to the first side support member **26*a* by way of one or more flotation support lines 34. The anchor members 32 are coupled to the second support member 26*b* by way of one or more anchor support lines 36. Optionally, additional side support members 26*c*, 26*d* may be provided around the remaining edges of the screen 24 to provide further support for the screen 24. Although the witness screen 24** shown is rectangular shaped, the present invention contemplates screens of any possible shape and size, with attendant side edges, support members, and flotation and anchor support points.

In an alternative embodiment, the side support members **26*a*–26*d* are buoyant and provide the support in the first direction 2 without requiring the separate flotation member 30. In another alternative, the screen 24 can be used without any side support members 26 as long as the screen 24 is held taut by the support lines 34, 36 coupling the flotation member 30 and anchor members 32 to the witness screen 24. In another alternative, side support member 26*a* is buoyant and 26*b*** is negatively buoyant.

Figure 3:
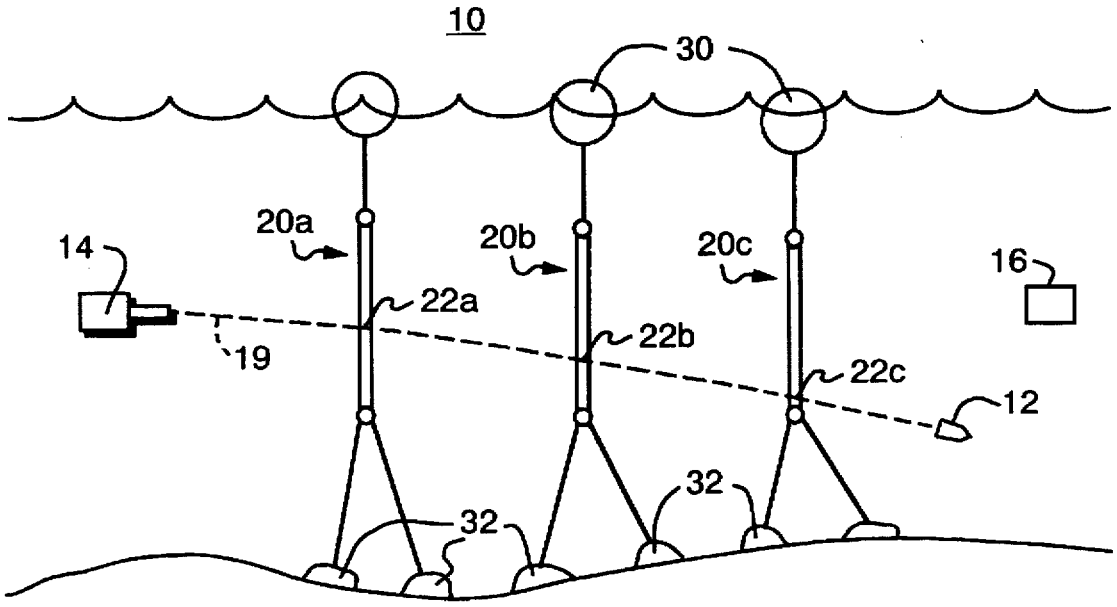
FIG. 3 is a schematic side view of a projectile testing system having a plurality of penetrable members according to one embodiment of the present invention.

According to one embodiment of the projectile testing system 10, FIG. 3, multiple penetrable members **20*a*–20*c* are positioned consecutively along the possible path of a projectile 12. Each penetrable member 20*a*–20*c* may be supported by independent flotation members 30 and anchor members 32 or alternatively, a single flotation member (not shown) and a single anchor member (not shown) that supports all of the consecutive penetrable members 20*a*–20*c*. By observing the penetrations 22*a*–22*c* through each of the consecutive penetrable members 20*a*–20*c*, the consecutive penetrable members 20*a*–20*c* allow an even more accurate determination or assessment of the actual flight path 19 taken by a projectile 12**.

Figure 4:
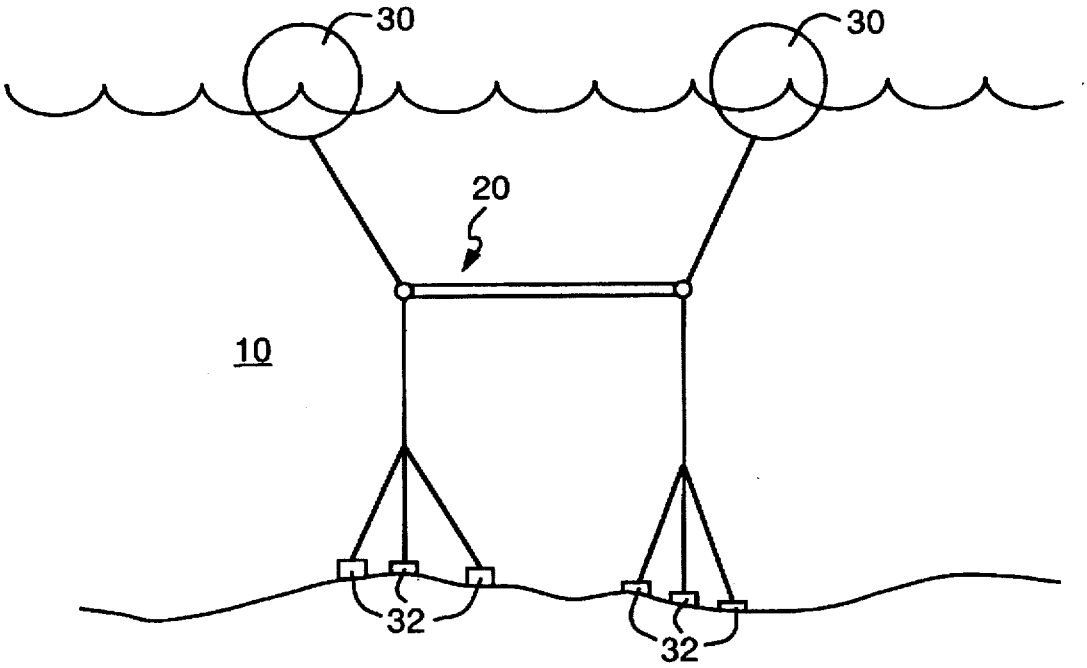
FIG. 4 is a schematic side view of a projectile testing system having a penetrable member positioned substantially in a horizontal plane according to another embodiment of the present invention.

Another embodiment of the projectile testing system 10, FIG. 4, includes orienting the penetrable member 20 in various directions or planes, such as horizontally. By using various arrangements of flotation members 30 and anchor members 32, or other types of supports, the penetrable member 20 can be positioned substantially orthogonal to virtually any possible projectile flight path.

Accordingly, the projectile testing system according to the present invention provides for the accurate recording and assessment of the actual flight taken by an underwater projectile. The projectile testing system can be used in an uncontrolled environment, such as an open sea environment, in which the projectile flight can be tested for longer ranges and with changing currents, temperature and pressure.

In light of the above, it is therefore understood that within the scope of the appended claims, the invention may be practiced otherwise than as specifically described.

What is claimed is:

1. A projectile testing system, for recording a path of at least one projectile projected from at least one projectile launcher, said projectile testing system comprising:

at least one penetrable member positioned in said path of said at least one projectile, for receiving said at least one projectile and forming a penetration, said at least one penetrable member being adapted to provide a location, a size and a shape of said penetration;

at least one flotation member coupled to a first edge of said at least one penetrable member, for supporting said at least one penetrable member in a first direction; and at least one anchor member coupled to a second edge of said at least one penetrable member, for supporting said at least one penetrable member in a second direction.

2. The projectile testing system of claim 1 wherein said at least one penetrable member is positioned at a predetermined distance and orientation with respect to said at least one projectile launcher, and wherein said path of said at least one projectile is determined based upon said predetermined distance and orientation of said at least one penetrable member with respect to said at least one projectile launcher.

3. The projectile testing system of claim 1 wherein said penetrable member is made from a mesh, and wherein said mesh allows said at least one projectile to penetrate said mesh without substantially slowing a velocity of said at least one projectile.

4. The projectile testing system of claim 1 wherein said at least one penetrable member is substantially flat and lies in a plane substantially orthogonal to said path of said at least one projectile.

5. The projectile testing system of claim 4 wherein said at least one flotation member and said at least one anchor member hold said at least one penetrable member taut in said plane substantially orthogonal to said path of said at least one projectile.

6. The projectile testing system of claim 1 further comprising at least first and second side support members positioned respectively along said first and second edges of said at least one penetrable member, for coupling said at least one penetrable member to said at least one flotation member and said at least one anchor member respectively.

7. The projectile testing system of claim 6 further comprising at least one support line extending from said at least first and second side support members to said at least one flotation member and said at least one anchor member respectively.

8. A plurality of projectile testing systems as set forth in claim 7 wherein the penetrable members are positioned consecutively in said path of said at least one projectile.

9. The projectile testing system of claim 1 further comprising a plurality of side support members positioned around each edge of said at least one penetrable member, for supporting said at least one penetrable member and for holding said at least one penetrable member taut.

10. The projectile testing system of claim 1 wherein said at least one penetrable member is positioned in a substantially vertical plane.

11. The projectile testing system of claim 1 wherein said at least one penetrable member is positioned in a substantially horizontal plane.

12. The projectile testing system of claim 1 wherein said at least one penetrable member is positioned in an underwater environment.

13. The projectile testing system of claim 12 wherein said at least one projectile launcher is positioned in said underwater environment.

14. The projectile testing system of claim 12 wherein said at least one projectile launcher is positioned above said underwater environment.

15. A method of testing a projectile launched from a projectile launcher, comprising the steps of:

providing a projectile testing system including at least one penetrable member and at least one penetrable member support, for supporting said penetrable member;

positioning said at least one penetrable member substantially orthogonally to a flight path of said projectile;

launching said projectile from a projectile launcher;

allowing said projectile to penetrate said at least one penetrable member to form a penetration in said penetrable member; and assessing said flight path taken by said projectile by observing a size, shape, and location of said penetration.

16. The method of claim 15 wherein said step of positioning said penetrable member substantially orthogonally to said flight path of said projectile includes positioning said at least one penetrable member in an underwater environment.

17. The method of claim 15 wherein said step of assessing said flight path of said projectile further includes determining a distance and orientation of said at least one penetrable member with respect to said projectile launcher.

18. The method of claim 17 further including the steps of:

providing a plurality of projectile testing systems each including at least one penetrable member and at least one penetrable member support for supporting said penetrable member; and positioning said plurality of penetrable members consecutively in said flight path of said projectile.

* * * * *